US009247821B1

(12) United States Patent
Wu

(10) Patent No.: US 9,247,821 B1
(45) Date of Patent: Feb. 2, 2016

(54) MODIFIED BACK RACK

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 0 days.

(21) Appl. No.: 14/456,430

(22) Filed: Aug. 11, 2014

(51) Int. Cl.
*A47C 7/40* (2006.01)

(52) U.S. Cl.
CPC ..... *A47C 7/402* (2013.01)

(58) Field of Classification Search
CPC ..... A47C 7/402
USPC ..... 297/353, 411.36
See application file for complete search history.

(56) References Cited

U.S. PATENT DOCUMENTS 4,639,039 A * 1/1987 Donovan ..... 297/353
6,299,253 B1 * 10/2001 Chen ..... 297/353
7,360,837 B1 * 4/2008 Liu ..... 297/353
7,775,593 B2 * 8/2010 Hu ..... 297/353
8,020,934 B2 * 9/2011 Hu ..... 297/353
8,128,309 B2 * 3/2012 Tsai ..... 403/322.1
2002/0063460 A1 * 5/2002 Roslund et al. ..... 297/353
2003/0057756 A1 * 3/2003 Lai ..... 297/353

* cited by examiner

*Primary Examiner* — Peter Brown
(74) *Attorney, Agent, or Firm* — Rabin & Berdo, P.C.

(57) ABSTRACT

A modified back rack has a front frame, a supporting stand mounted movably on the front frame, and a positioning mount mounted securely on the front frame. The front frame has an adjusting base mounted on the front frame. The adjusting base has a protrusion formed on the adjusting base, a track area formed on the adjusting base, and multiple positioning grooves formed on the protrusion. The supporting stand has a movement recess formed on the supporting stand, a movement space formed in the movement recess, and a moving assembly mounted in the movement recess. The moving assembly has a moving block, a swinging arm mounted pivotally in the moving block, and a moving pin extending from the swinging arm. The moving pin is placed in the track area. The modified back rack has height adjusting function that can meet different requirements.

10 Claims, 14 Drawing Sheets

MODIFIED BACK RACK

BACKGROUND OF THE INVENTION

1. Field of the Invention

The invention relates to a back rack of a chair, especially a modified back rack with an adjusting function.

2. Description of the Prior Arts

A back rack is one component of a chair, and a cushion is mounted on the back rack and supported by the back rack. The cushion can be used to support a back of a user to provide comfort to the user when the user is sitting on the seat.

A conventional back rack includes a front frame and a back stand connected pivotally to the front frame. A cushion is mounted securely on the front frame and is supported by the front frame, and the users' back leans on the cushion. The back stand is connected to a bottom base of the seat.

However, the front frame of the conventional back rack can only swing along a vertical direction or a lateral direction relative to the back stand, and a height of the front frame relative to the back stand cannot be adjusted. Therefore, for users with different statures or with different sitting postures, the height of the cushion cannot be adjusted to meet the requirements of the users for the comfortable supporting effect. Because of the pivotal connecting relation between the front frame and the back stand, the relative height between the front frame and the back stand cannot be changed. Then, the conventional back rack is not sufficient to meet the variable height requirements of different users.

To overcome the shortcomings, the present invention provides a modified back rack to mitigate or obviate the aforementioned problems.

SUMMARY OF THE INVENTION

The main objective of the present invention is to provide a modified back rack that has an adjusting function to meet requirements of different users.

The modified back rack has a front frame, a supporting stand mounted movably on the front frame, and a positioning mount mounted securely on the front frame. The front frame has an adjusting base mounted on the front frame. The adjusting base has a protrusion formed on the adjusting base, a track area formed on the adjusting base and multiple positioning grooves formed on the protrusion and vertically spaced apart from each other. The supporting stand has a movement recess formed on the supporting stand, a movement space formed in the movement recess, and a moving assembly mounted in the movement recess. The moving assembly has a moving block, a swinging arm mounted pivotally in the moving block, and a moving pin extending from the swinging arm. The moving pin is placed in the track area. The present invention has height adjusting function that can meet different requirements.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
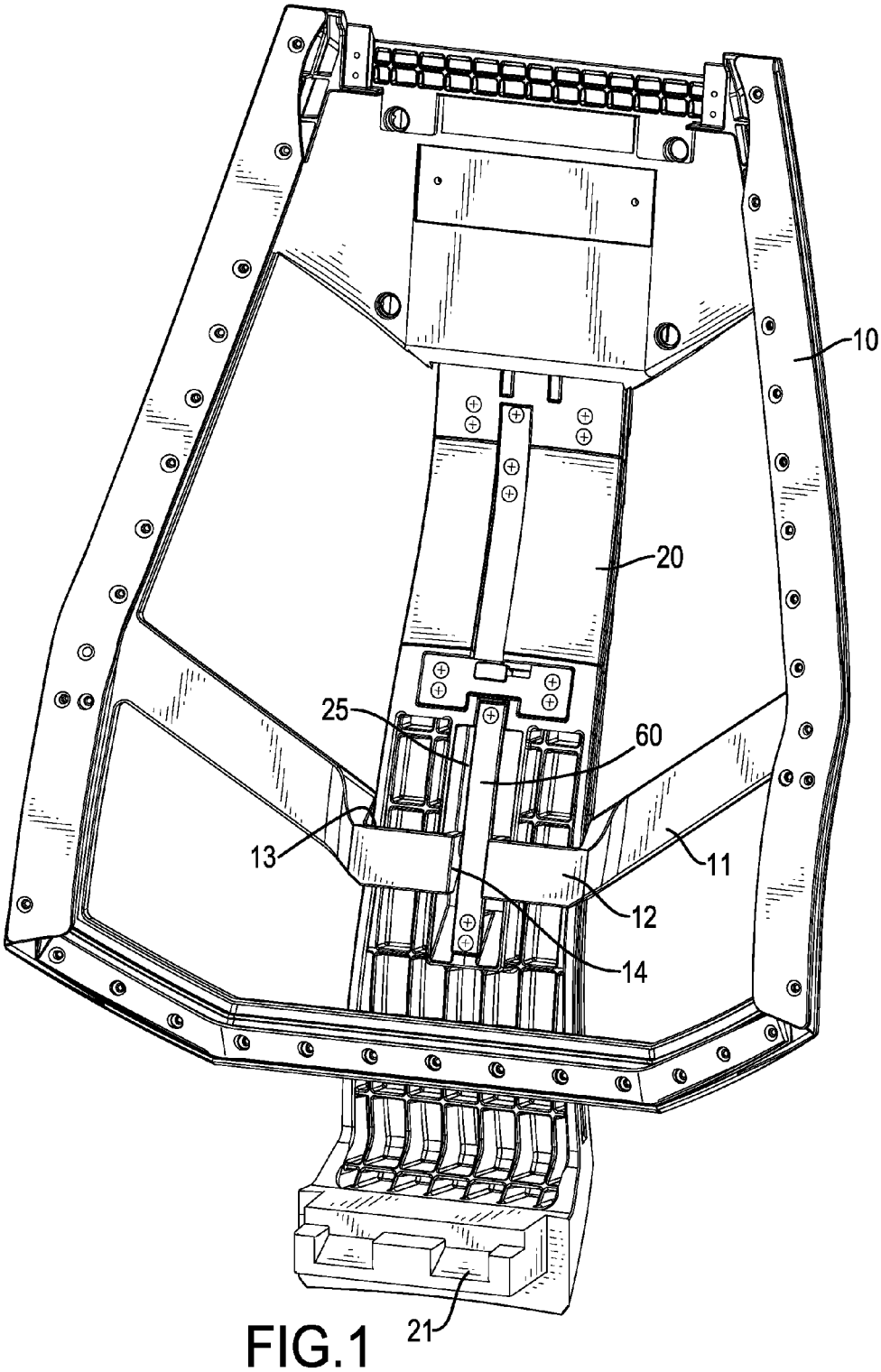
FIG. 1 is a perspective view of a modified back rack in accordance with the present invention.
Figure 2:
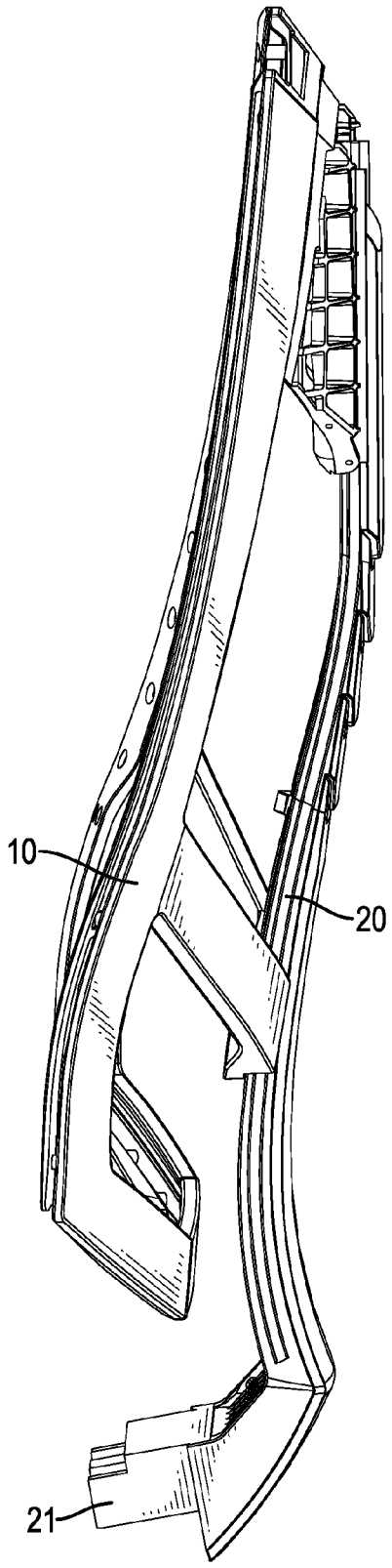
FIG. 2 is a perspective side view of the modified back rack in FIG. 1.

With reference to FIGS. 1 and 2, a modified back rack in accordance with the present invention comprises a front frame 10, a supporting stand 20, a positioning mount 30 and a moving assembly 40.

Figure 3:
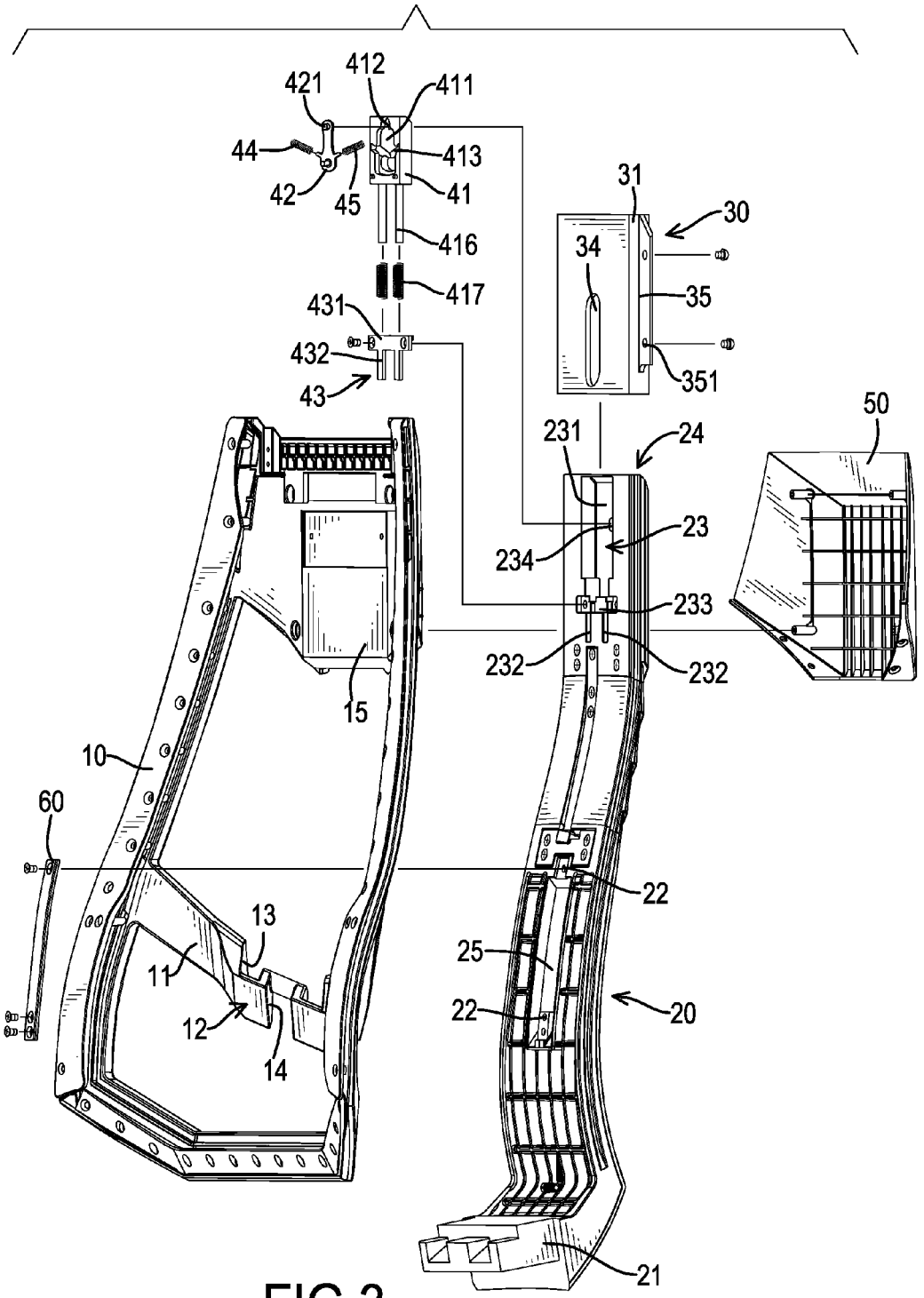
FIG. 3 is a front exploded perspective view of the modified back rack in FIG. 1.
Figure 4:
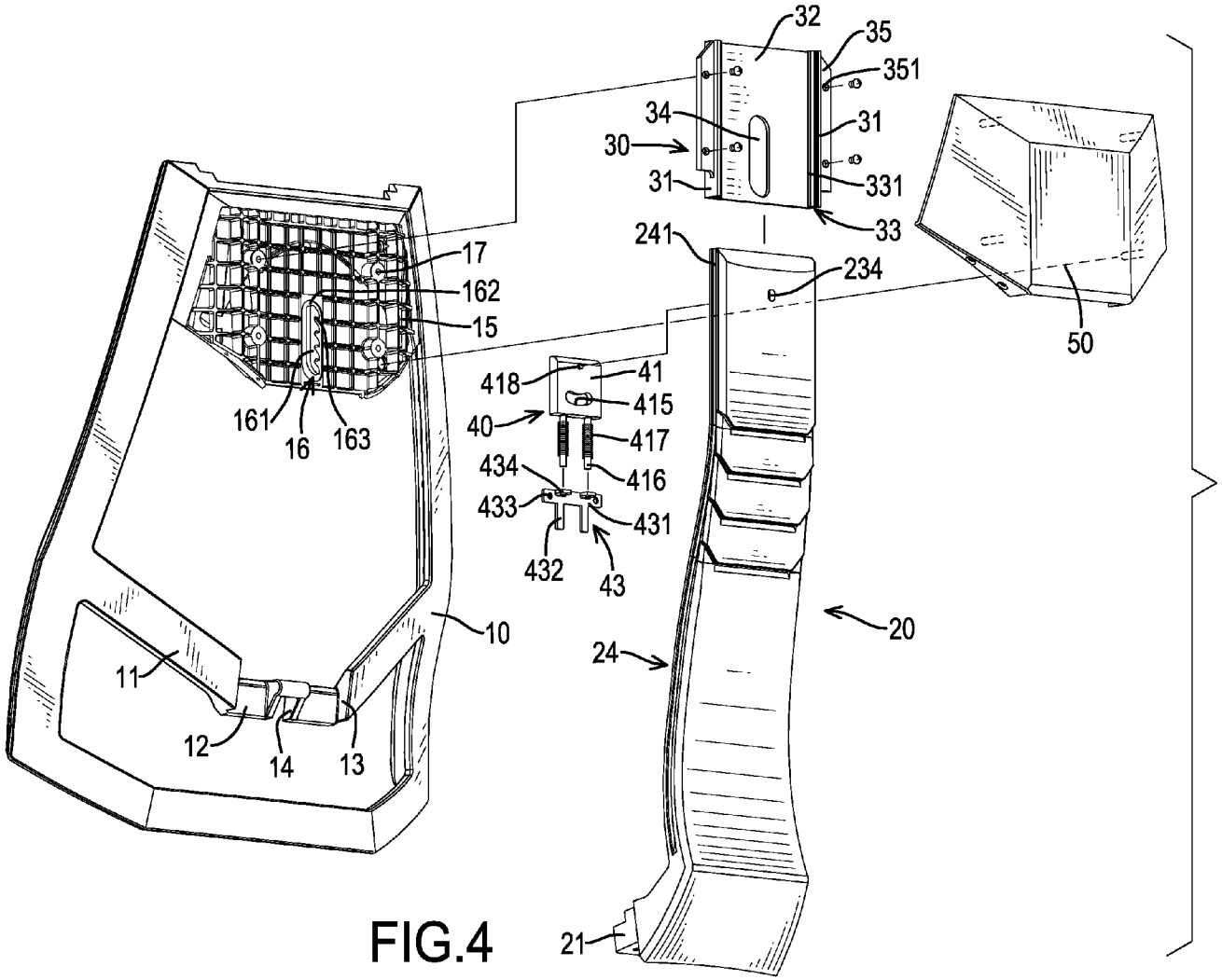
FIG. 4 is a rear exploded perspective view of the modified back rack in FIG. 1.
Figure 5:
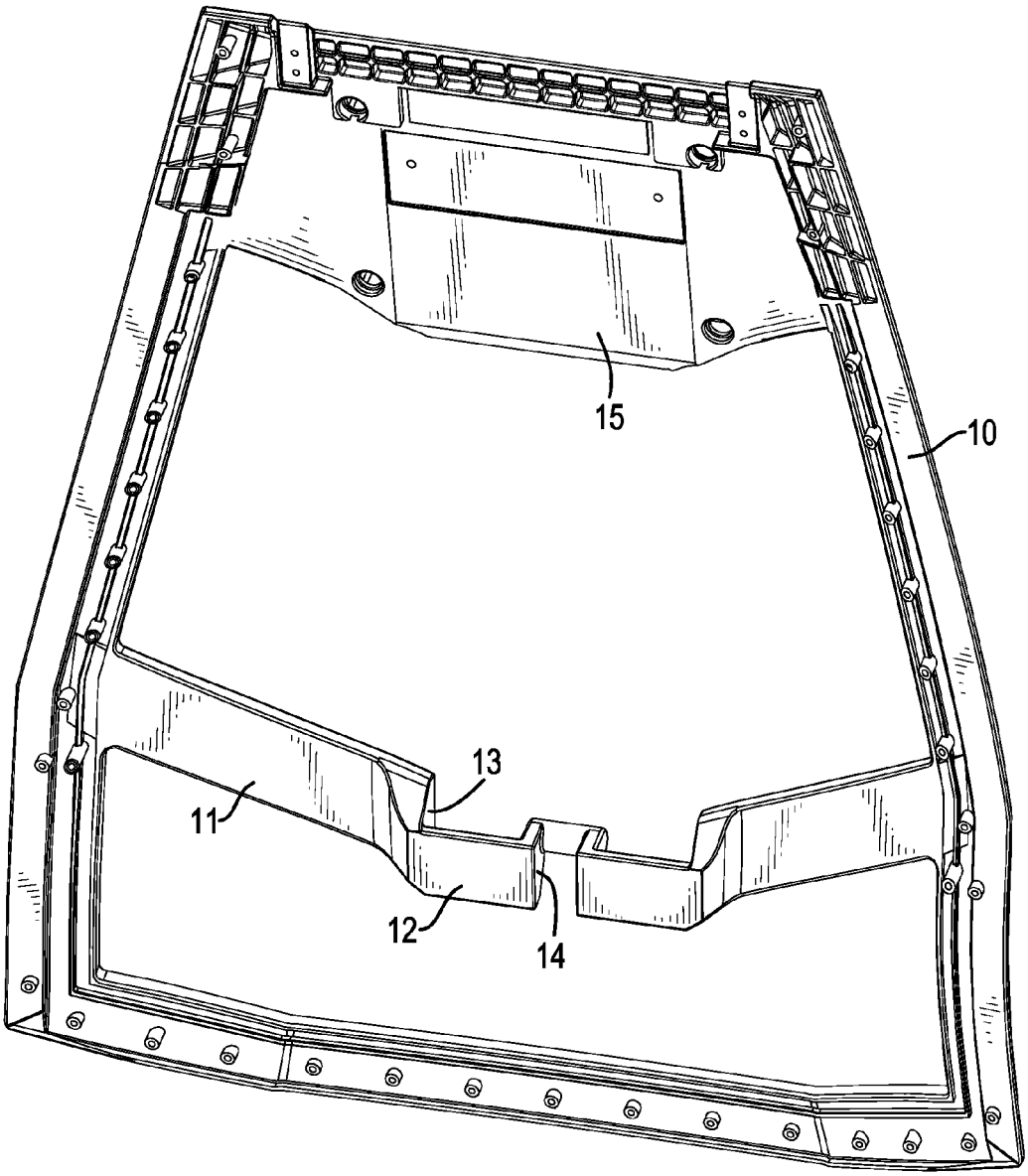
FIG. 5 is an enlarged perspective view of a front frame of the modified back rack FIG. 1.

With reference to FIGS. 3 and 4, the front frame 10 has a locating arm 11, a locating portion 12, a limiting area 13, a locating groove 14, a backing plate 15, an adjusting base 16 and multiple screw holes 17. The locating arm 11 is mounted laterally in the front frame 10. The locating portion 12 is formed on and protrudes from a central surface of the locating arm 11. As shown in FIG. 5, the limiting area 13 is concaved on a rear end of the locating portion 12, and the locating groove 14 is formed on a middle surface of the locating portion 12. The backing plate 15 is formed on a top end of the front frame 10 over the locating arm 11.

Figure 6:
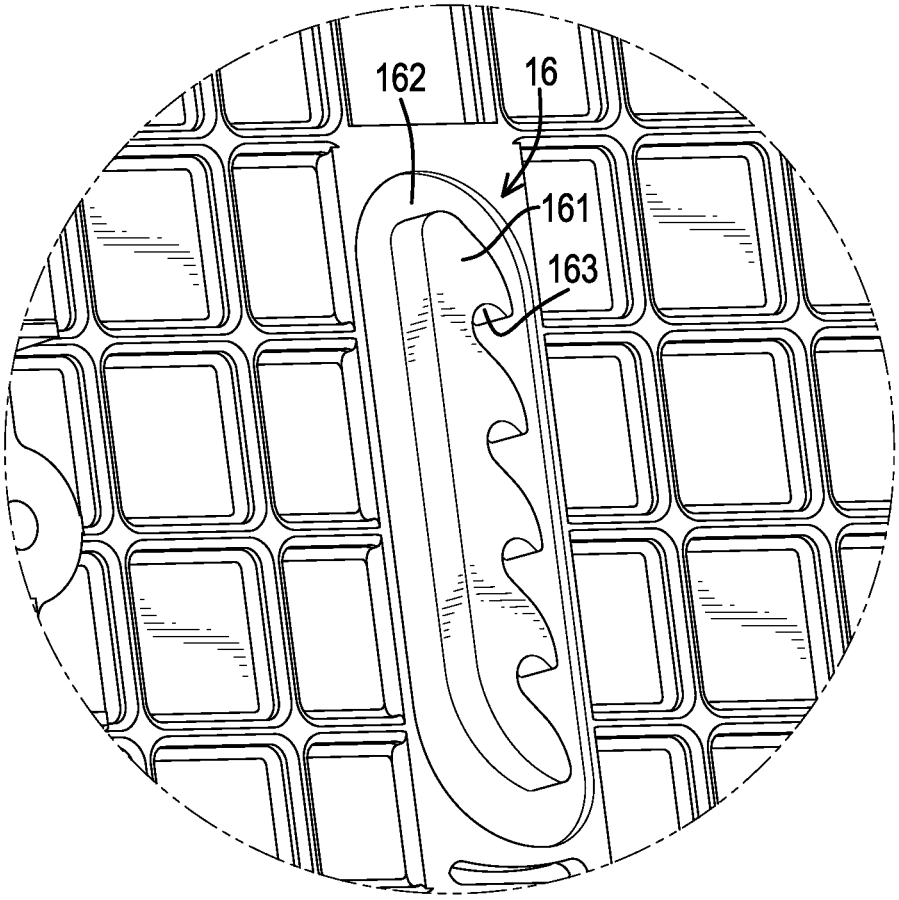
FIG. 6 is a partially enlarged rear view of the front frame of the modified back rack in FIG. 1.

The adjusting base 16 is formed on a rear end of the backing plate 15. The adjusting base 16 has a protrusion 161, a track area 162, and multiple positioning grooves 163. The protrusion 161 extends from the adjusting base 16, and the track area 162 is concaved in the adjusting base 16 around the protrusion 161. The positioning grooves 163 are formed perpendicularly on an outer surface of the protrusion 161 and communicate with the track area 162, and are vertically spaced from each other. With reference to FIG. 6, each one of the positioning grooves 163 is oblique. The screw holes 17 are formed on the rear end of the backing plate 15 around the adjusting base 16.

With further reference to FIGS. 3 and 4, the supporting stand 20 is mounted on the rear end of the front frame 10 and a width of the supporting stand 20 is equal to a width of the limiting area 13. The supporting stand 20 has a linking base 21, a slide groove 25, multiple threaded holes 22, a movement recess 23 and two inner tracks 24. The linking base 21 is mounted on a bottom end of the supporting stand 20 under the front frame 10. The slide groove 25 is formed on a front surface of the supporting stand 20 and corresponding to the locating groove 14. The threaded holes 22 are formed on two opposite ends of the slide groove 25.

Figure 7:
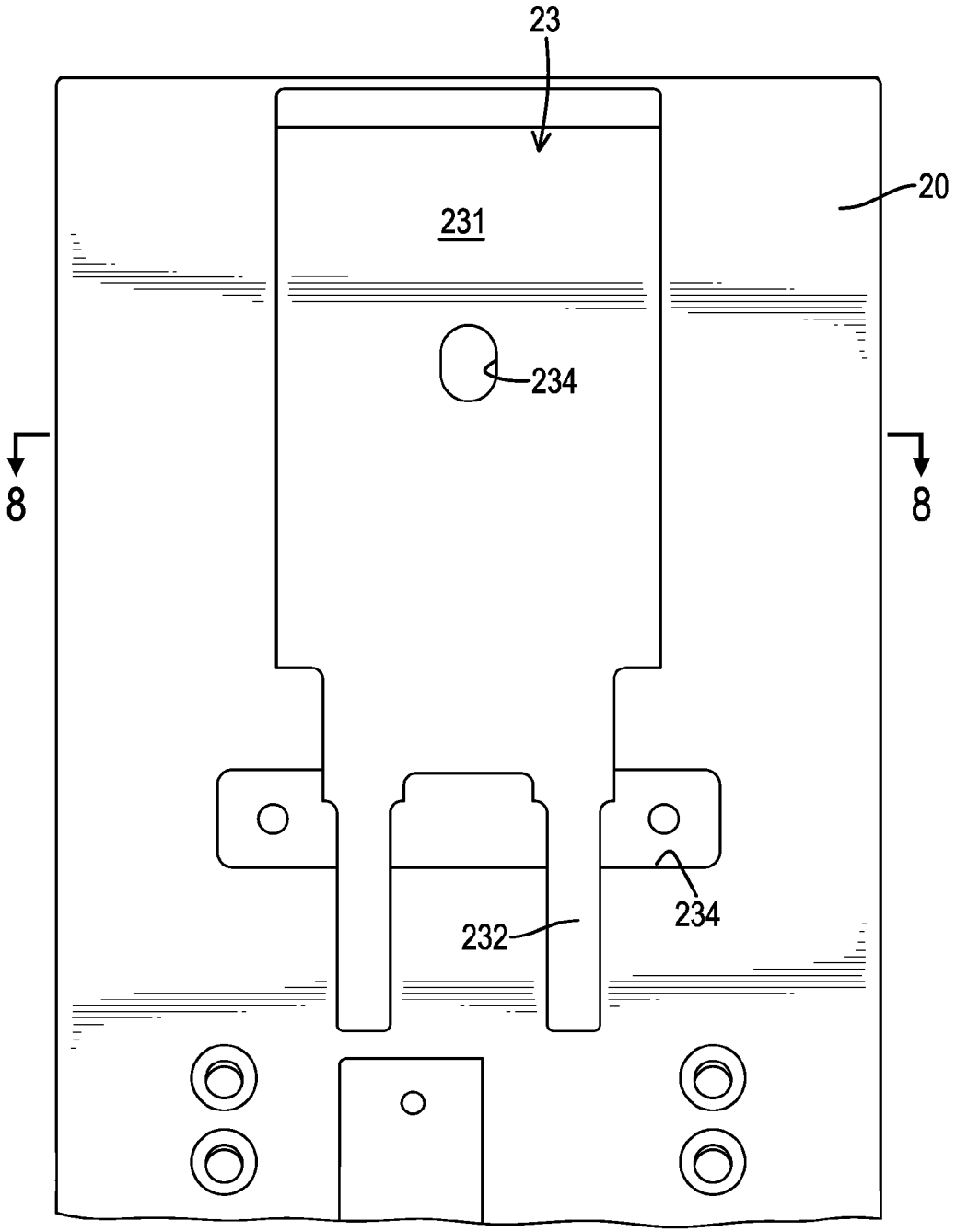
FIG. 7 is a partially enlarged front view of the supporting stand of the modified back rack in FIG. 1.
Figure 8:
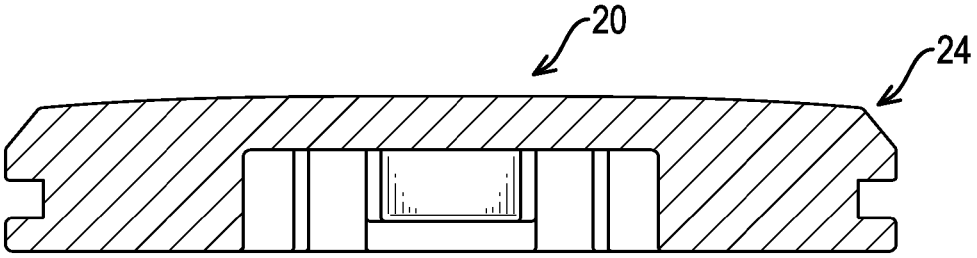
FIG. 8 is a cross-sectional side view of the supporting stand of the modified back rack along line 8-8 in FIG. 7.

With reference to FIGS. 7 and 8, the movement recess 23 is formed on a top end of the supporting stand 20 corresponding to the adjusting base 16, and has a movement space 231 formed in the movement recess 23, two elongated grooves 232 formed symmetrically in the movement recess 23 and communicating with the movement recess 23, a lateral groove 233 formed in the movement recess 23 and communicating with the elongated grooves 232, wherein a depth of the lateral groove 233 is smaller than a depth of each of the elongated grooves 232, and a limiting hole 234 formed through a rear end of the supporting stand 20 and communicating with the movement space 231. The inner tracks 24 are formed on two opposite outer surfaces of the supporting stand 20. In a preferred embodiment, the inner tracks 24 can be formed as guiding grooves as shown in FIG. 8 or can be formed as protruding bars.

Figure 9:
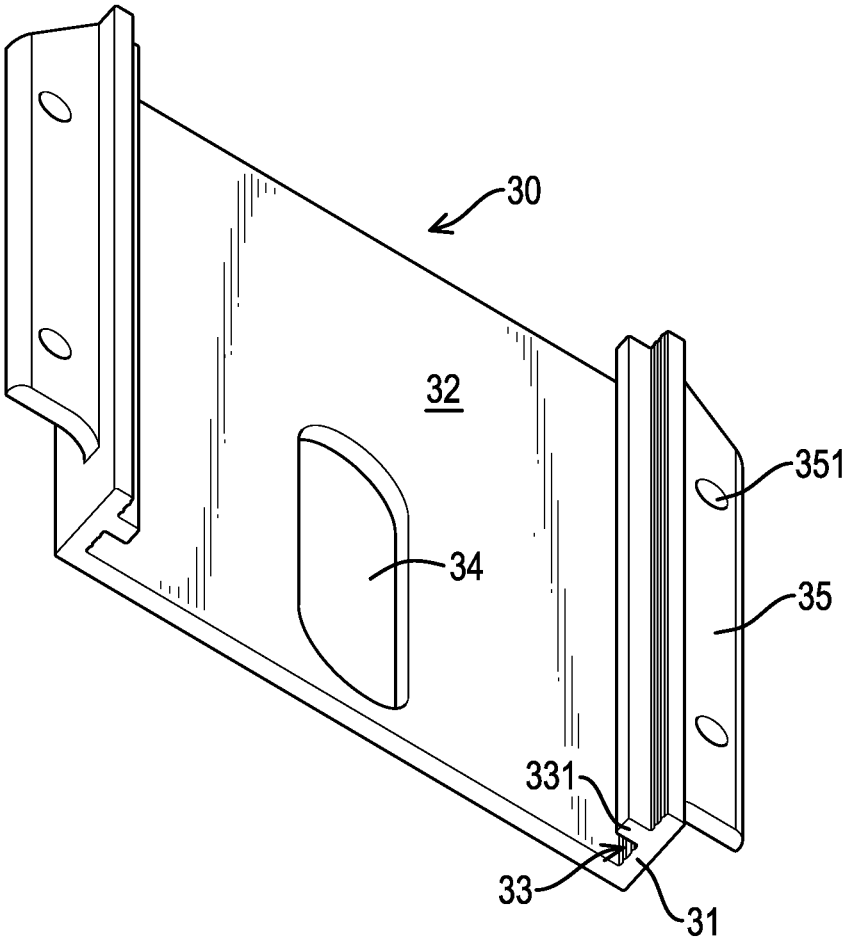
FIG. 9 is a perspective view of a positioning mount of the modified back rack in FIG. 1.

With reference to FIGS. 3, 4 and 9, the positioning mount 30 is mounted securely on the backing plate 15 of the front frame 10, and has two protruding plates 31, a through area 32, two outer tracks 33, a positioning hole 34 and two wings 35. The protruding plates 31 extend afterwards from two opposite sides of the positioning mount 30. The through area 32 is formed between the protruding plates 31, and the outer tracks 33 are located in the through area 32 and are formed on inner walls of the protruding plates 31. The through area 32 is mounted around the supporting stand 20, and the outer tracks 33 engage with the inner tracks 24. In a preferred embodiment, the outer tracks 33 can be formed as protruding bars 331 corresponding to the guiding grooves 241 of the inner track 24 or can be formed as concave grooves corresponding to the protruding bars of the inner tracks 24. The positioning hole 34 is formed through the through area 32 and corresponds to the track area 162 of the adjusting base 16. The wings 35 are respectively formed on and protrude from two outer sides of the protruding plates 31, and each wing 35 has multiple through holes 351 formed through the wing 35.

Figure 10:
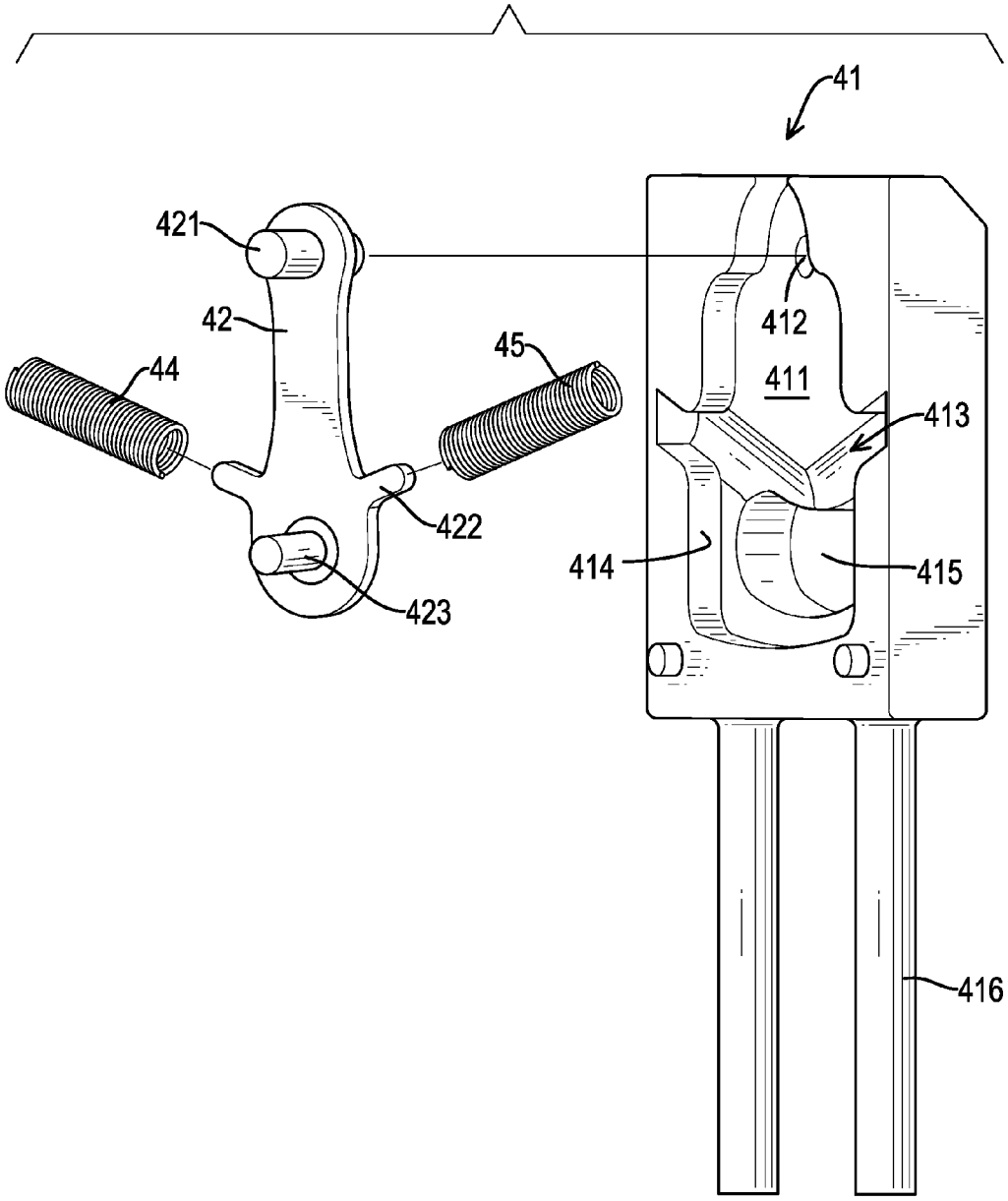
FIG. 10 is an exploded and enlarged perspective view of a moving assembly of the modified back rack in FIG. 3.

With reference to FIGS. 3, 4 and 10, the moving assembly 40 is mounted in the top end of the supporting stand 20 and has a moving block 41, a swinging arm 42, a locating sheet 43, a first spring 44 and a second spring 45. The moving block 41 is mounted in the movement space 231 of the movement recess 23, a width of the moving block 41 is equal to a width of the movement space 231, and a height of the moving block 41 is smaller than a height of the movement space 231.

The moving block 41 has a fixing groove 411 formed on a front surface of the moving block 41, a locating hole 412 formed in a top end of the fixing groove 411, two oblique slots 413 formed in two central sides of the fixing groove 411, a bottom groove 414 extending from a bottom end of the fixing groove 411, an arc hole 415 formed through the bottom groove 414, two locating rods 416 protruding from a bottom surface of the moving block 41 and respectively mounted in the corresponding elongated grooves 232, two third springs 417 mounted around the locating rods 416, and a fastening pin 418 formed on a rear end of the moving block 41 and mounted through the limiting hole 234 of the movement space 23.

The swinging arm 42 is mounted in the moving block 41 and has a fixing pin 421 extending from a top end of the swinging arm 42 and pivotally mounted in the locating hole 412, two protruding elements 422 extending from the swinging arm 42 and mounted in the corresponding oblique slots 413, and a moving pin 423 extending from a bottom end of the swinging arm 42 and mounted through the positioning hole 34 and located in the track area 162. The moving pin 423 is held in one of the positioning grooves 163 to adjust a vertical position of the front frame 10.

The locating sheet 43 has a lateral plate 431 mounted in the lateral groove 233, two fixing plates 432 extending downwardly from the lateral plate 431 and mounted in the elongated grooves 232 to cover the locating rods 416, two fixing holes 433 formed through the lateral plate 431, and two limiting protruding sheets 434 formed on a rear end of the lateral plate 431, wherein the limiting protruding sheets 434 are mounted around the locating rods 416 and are pressed by the third springs 417.

Figure 12:
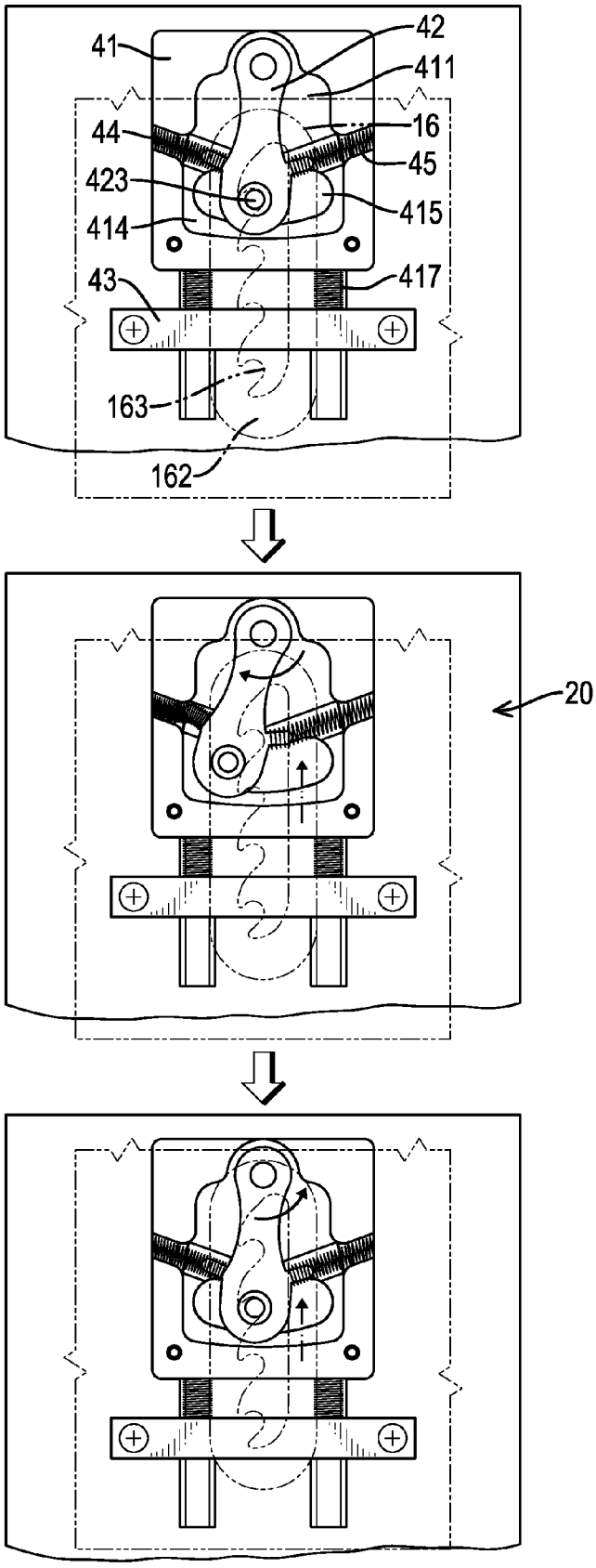
FIG. 12 is an operational side view of the moving pin rolling in a track area in FIG. 11.
Figure 13:
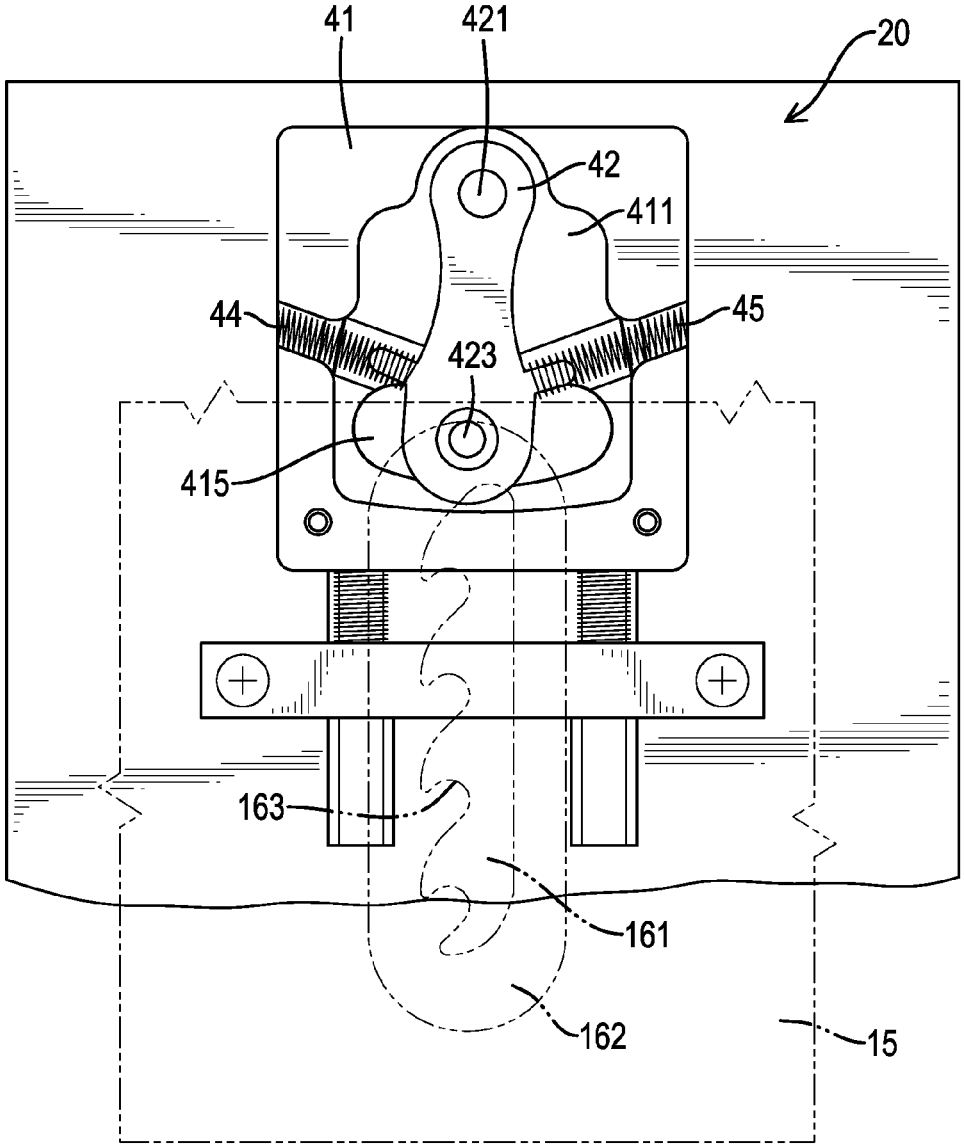
FIG. 13 is an operational side view of the moving pin located in a top of the track area in FIG. 11.

With reference to FIGS. 10, 12 and 13, the first spring 44 and the second spring 45 are respectively mounted around the protruding elements 422 of the swinging arm 42 and respectively lean against the oblique slots 413, and a stiffness of the first spring 44 is larger than a stiffness of the second spring 45. So the swinging arm 42 is slanted in a direction toward the second spring 45, and the second spring 45 is compressed by the swinging arm 42. The locating sheet 43 is mounted securely in the lateral groove 233 by locking components.

The supporting stand 20 is mounted and positioned in the positioning mount 30, and the positioning mount 30 can be moved vertically along the supporting stand 20 due to the connection between the inner tracks 24 and the outer tracks 33. The modified back rack of the present invention has a cover 50 mounted on the rear end of the supporting stand 20 and covered securely on the positioning mount 30. Multiple locking components are mounted through the cover 50 and the through holes 351 and then are fastened in the screw holes 17.

With reference to FIG. 1, the modified back rack of the present invention has a vertical buckle 60 mounted in the locating groove 14 and locked in the threaded holes 22 of the supporting stand 20 by using locking components. So the front frame 10 is limited by the supporting stand 20 to move along the slide groove 25.

Figure 11:
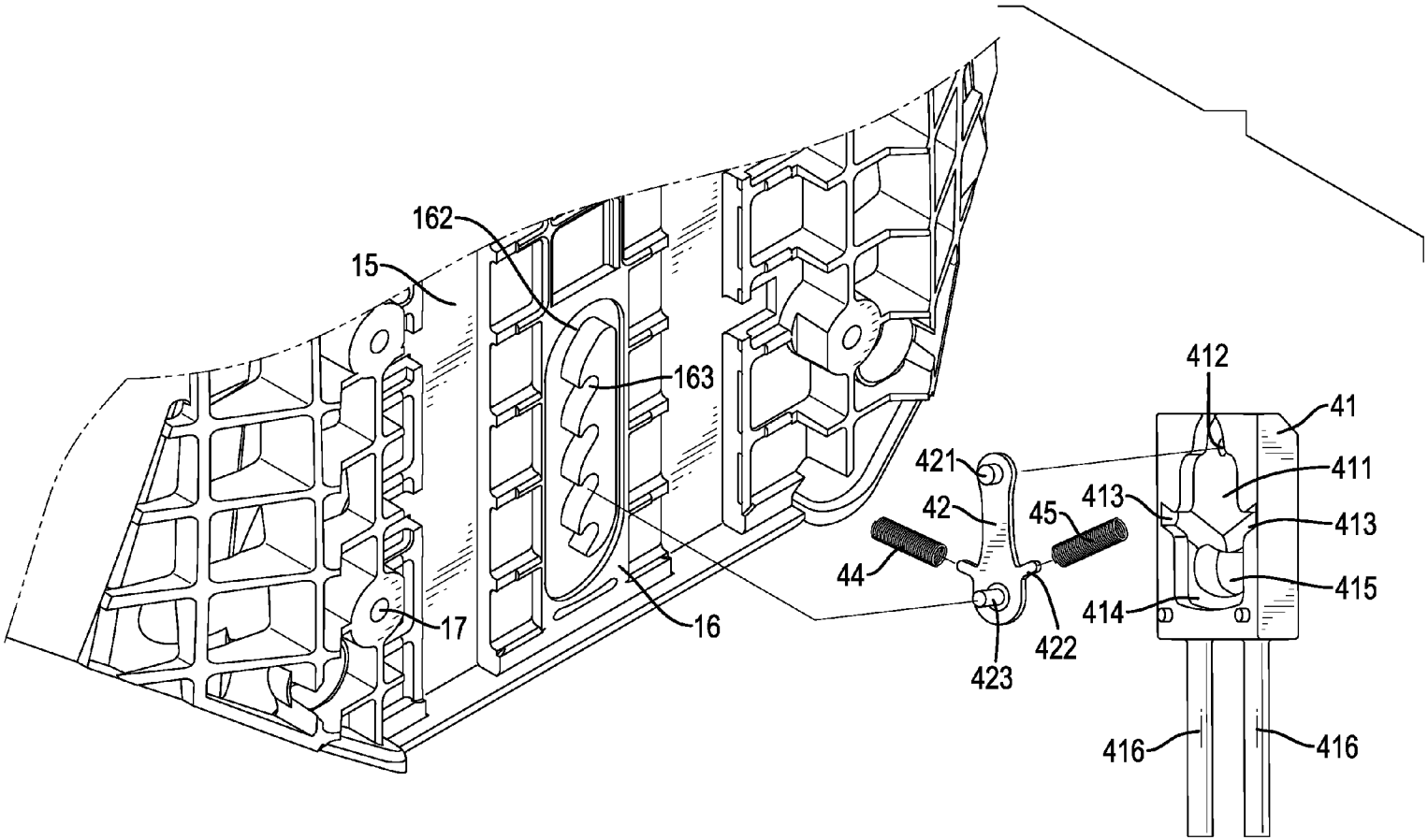
FIG. 11 is an exploded and enlarged perspective view of the moving assembly and the front frame of the modified back rack in FIG. 1.
Figure 14:
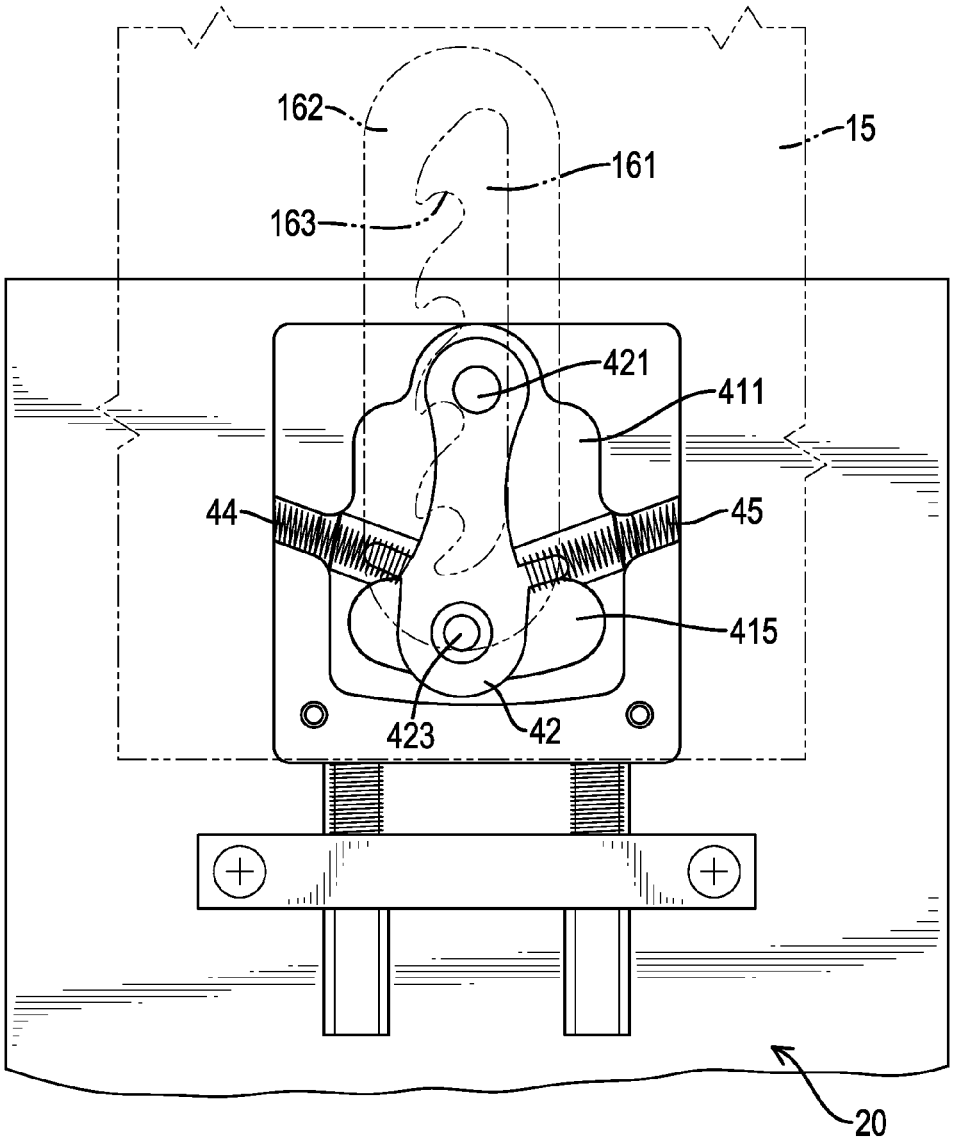
FIG. 14 is an operational side view of the moving pin located in a bottom of the track area in FIG. 11.

With reference to FIGS. 3, 11 and 12, when adjusting a height of the front frame 10 relative to the supporting stand 20, the front frame 10 is pulled upwards to make the moving pin 423 of the swinging arm 42 move downwards along the track area 162 to leave a corresponding positioning groove 163. When the moving pin 423 moves to a next positioning groove 163, the moving pin 423 is held in the corresponding positioning groove 163 by the elastic force of the first spring 44. With reference to FIGS. 12 to 14, in the adjusting process, the swinging arm 42 and the moving block 41 are slightly moved downwards in the movement space 231 and are pushed by the protrusion 161, but are returned quickly to the original position when rolling to one of the positioning grooves 163 due to the elastic forces of the first spring 44 and the second spring 45. At the moment, the moving pin 423 is fastened in the next positioning groove 163, and the front frame 10 is lifted to a higher position.

With reference to FIGS. 6, 13 and 14, the present invention has four positioning grooves 163 and can be adjusted to four different heights. When the moving pin 423 leaves the lowest positioning groove 163, the moving pin 423 can move back to the top end of the track area 162 due to the weights of the front frame 10. The front frame 10 is repeatedly pulled for being fastened in one of the positioning grooves 163. So the front frame 10 of the modified back rack of the present invention can be adjusted for the height relative to the supporting stand 20, and different users can adjust the heights of the front frame based on the personal requirements for improved practicality of the chair.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A modified back rack comprising:

a front frame having an adjusting base mounted on a rear end of the front frame and having a protrusion formed on a central surface of the adjusting base;

a track area formed on the adjusting base and around the protrusion; and multiple positioning grooves formed on an outer surface of the protrusion, communicating with the track area and vertically spaced apart from each other;

a supporting stand mounted movably on a rear side of the front frame and having a movement recess formed on a top end of the supporting stand and having a movement space formed in the movement recess;

a positioning mount mounted securely on the rear side of the front frame and mounted through by the supporting stand; and a moving assembly mounted in the movement space of the movement recess and having a moving block;

a swinging arm mounted pivotally in a front end of the moving block; and a moving pin extending forward on a bottom end of the swinging arm, mounted through the positioning mount, placed in the track area of the front frame and held in one of the positioning grooves of the track area to adjust a vertical position of the front frame;

wherein the front frame can move along the supporting stand in a vertical direction.

2. The modified back rack as claimed in claim 1, wherein each one of the positioning grooves is oblique;

the moving block has a fixing groove formed on a front surface of the moving block and having two central sides; and two oblique slots formed in the two central sides of the fixing groove;

the swinging arm is mounted in the moving block and has two protruding elements extending from the swinging arm and mounted in the oblique slots; and the moving assembly has a first spring and a second spring respectively mounted around the protruding elements of the swinging arm and pressing against the two oblique slots.

3. The modified back rack as claimed in claim 2, wherein the movement recess of the supporting stand has two elongated grooves formed symmetrically in the movement recess and communicating with the movement recess;

a lateral groove formed in the movement groove and communicating with the elongated groove, wherein a depth of the lateral groove is smaller than a depth of each of the elongated grooves; and a limiting hole formed through a rear end of the supporting stand and communicating with the movement space;

the moving block has two locating rods protruding from a bottom surface of the moving block and respectively mounted in the elongated grooves;

two third springs mounted around the locating rods; and a fastening pin formed on a rear end of the moving block and mounted through the limiting hole of the movement recess;

the moving assembly has a locating sheet having a lateral plate mounted in the lateral groove;

two fixing plates extending downward from the lateral plate and mounted in the elongated grooves; and two limiting protruding sheets formed on a rear end of the lateral plate and mounted around the locating rods.

4. The modified back rack as claimed in claim 3, wherein the front frame has a locating arm mounted laterally in the front frame;

a locating portion formed on and protruding from a central surface of the locating arm;

a limiting area concaved on a rear end of the locating portion;

a locating groove formed on a middle surface of the locating portion; and a backing plate formed on a top end of the front frame over the locating arm;

the positioning mount is mounted securely on the backing plate of the front frame and has two protruding plates extending rearwards from two opposite sides of the positioning mount;

a through area formed between the protruding plates; and two outer tracks located in the through area and formed on inner walls of the protruding plates;

the supporting stand has a width equal to a width of the limiting area, the supporting stand having a slide groove formed on a front surface of the supporting stand and corresponding to the locating groove;

multiple threaded holes formed on two opposite ends of the slide groove; and two inner tracks formed on two opposite outer surfaces of the supporting stand and engaging the outer tracks; and the modified back rack has a vertical buckle mounted in the locating groove and locked on the threaded holes of the supporting stand.

5. The modified back rack as claimed in claim 2, wherein the front frame has a locating arm mounted laterally in the front frame;

a locating portion formed on and protruding from a central surface of the locating arm; and a limiting area concaved on a rear end of the locating portion;

a locating groove formed on a middle surface of the locating portion; and a backing plate formed on a top end of the front frame over the locating arm;

the positioning mount is mounted securely on the backing plate of the front frame and has two protruding plates extending rearwards from two opposite sides of the positioning mount;

a through area formed between the protruding plates; and two outer tracks located in the through area and formed on inner walls of the protruding plates;

the supporting stand has a width equal to a width of the limiting area, the supporting stand having a slide groove formed on a front surface of the supporting stand and corresponding to the locating groove;

multiple threaded holes formed on two opposite ends of the slide groove; and two inner tracks formed on two opposite outer surfaces of the supporting stand and engaging the outer tracks; and the modified back rack has a vertical buckle mounted in the locating groove and locked on the threaded holes of the supporting stand.

6. The modified back rack as claimed in claim 2, wherein the positioning mount has two wings formed and protruding from outer sides of the positioning mount, and each wing having multiple through holes formed through the wing; and the modified back rack has a cover mounted on the supporting stand and covered securely on the positioning mount; and multiple locking components mounted through the cover and the through holes and locked in the rear end of the front frame.

7. The modified back rack as claimed in claim 1, wherein the movement recess of the supporting stand has two elongated grooves formed symmetrically in the movement recess and communicating with the movement recess;

a lateral groove formed in the movement recess and communicating with the elongated groove, wherein a depth of the lateral groove is smaller than a depth of each of the elongated grooves; and a limiting hole formed through a rear end of the supporting stand and communicating with the movement space;

the moving block has two locating rods protruding from a bottom surface of the moving block and respectively mounted in the elongated grooves;

two third springs mounted around the locating rods; and a fastening pin formed on a rear end of the moving block and mounted through the limiting hole of the movement recess;

the moving assembly has a locating sheet having a lateral plate mounted in the lateral groove;

two fixing plates extending downward from the lateral plate and mounted in the elongated grooves; and two limiting protruding sheets formed on a rear end of the lateral plate and mounted around the locating rods.

8. The modified back rack as claimed in claim 7, wherein the front frame has a locating arm mounted laterally in the front frame;

a locating portion formed on and protruding from a central surface of the locating arm;

a limiting area concaved on a rear end of the locating portion;

a locating groove formed on a middle surface of the locating portion; and a backing plate formed on a top end of the front frame over the locating arm;

the positioning mount is mounted securely on the backing plate of the front frame and has two protruding plates extending rearwards from two opposite sides of the positioning mount;

a through area formed between the protruding plates; and two outer tracks located in the through area and formed on inner walls of the protruding plates;

the supporting stand has a width equal to a width of the limiting area, the supporting stand having a slide groove formed on a front surface of the supporting stand and corresponding to the locating groove;

multiple threaded holes formed on two opposite ends of the slide groove; and two inner tracks formed on two opposite outer surfaces of the supporting stand and engaging the outer tracks; and the modified back rack has a vertical buckle mounted in the locating groove and locked on the threaded holes of the supporting stand.

9. The modified back rack as claimed in claim 1, wherein the front frame has a locating arm mounted laterally in the front frame;

a locating portion formed on and protruding from a central surface of the locating arm; and a limiting area concaved on a rear end of the locating portion;

a locating groove formed on a middle surface of the locating portion; and a backing plate formed on a top end of the front frame over the locating arm;

the positioning mount is mounted securely on the backing plate of the front frame and has two protruding plates extending rearwards from two opposite sides of the positioning mount;

a through area formed between the protruding plates; and two outer tracks located in the through area and formed on inner walls of the protruding plates;

the supporting stand has a width equal to a width of the limiting area, the supporting stand having a slide groove formed on a front surface of the supporting stand and corresponding to the locating groove;

multiple threaded holes formed on two opposite ends of the slide groove; and two inner tracks formed on two opposite outer surfaces of the supporting stand and engaging the outer tracks; and the modified back rack has a vertical buckle mounted in the locating groove and locked in the threaded holes of the supporting stand.

10. The modified back rack as claimed in claim 1, wherein the positioning mount has two wings formed and protruding from outer sides of the positioning mount, and each wing having multiple through holes formed through the wing; and the modified back rack has a cover mounted on the supporting stand and covered securely on the positioning mount; and multiple locking components mounted through the cover and the through holes and locked in the rear end of the front frame.

* * * * *